United States Patent [19]

Rushing

[11] Patent Number: 4,853,738

[45] Date of Patent: Aug. 1, 1989

[54] COLOR QUALITY IMPROVEMENTS FOR ELECTROPHOTOGRAPHIC COPIERS AND PRINTERS

[75] Inventor: Allen J. Rushing, Webster, N.Y.

[73] Assignee: Eastman Kodak Company, Rochester, N.Y.

[21] Appl. No.: 189,091

[22] Filed: May 2, 1988

[51] Int. Cl.[4] ..... G03G 15/01

[52] U.S. Cl. ..... 355/327; 355/204; 355/246

[58] Field of Search ..... 355/4, 14 R, 3 R, 38, 355/69, 77, 88

[56] References Cited

U.S. PATENT DOCUMENTS

| | | | |
|---|---|---|---|
| 3,799,668 | 3/1974 | McVeigh | 355/4 |
| 4,068,940 | 1/1978 | Bobbe | 355/4 |
| 4,159,174 | 6/1979 | Rising | 355/38 |
| 4,385,823 | 5/1983 | Kasper et al. | 355/3 R |
| 4,577,954 | 3/1986 | Kajiwara | 355/4 |
| 4,615,607 | 10/1986 | Yanagawa et al. | 355/4 X |
| 4,734,735 | 3/1988 | Haneoa | 355/4 |
| 4,809,037 | 2/1989 | Sato | 355/4 |

FOREIGN PATENT DOCUMENTS

| | | |
|---|---|---|
| 0084228 | 7/1983 | European Pat. Off. . |
| 0080350 | 4/1985 | European Pat. Off. . |
| 0144188 | 6/1985 | European Pat. Off. . |

*Primary Examiner*—A. C. Prescott

*Attorney, Agent, or Firm*—Milton S. Sales

[57] ABSTRACT

Disclosed is apparatus and procedure for automatic set up and/or maintenance of process control parameters for good color balance, color fidelity, and tone reproduction by exploiting all of the available process parameter adjustments based on several density measurements in each of a plurality of color separations. Density measurements are made of a plurality of color separations across a range of densities for each color separation. Process control parameter adjustments are calculated utilizing the known average human relative visual sensitivities to density and color shifts at various density levels, to achieve an optimum set up compromise over all the colors. If certain colors or densities are particularly important in the scene of the original document, those colors or densities are more heavily weighted in the adjustment calculations. The adjustment procedure is preferably iterated a few times to attain convergence to the "best" set up.

14 Claims, 4 Drawing Sheets

COLOR QUALITY IMPROVEMENTS FOR ELECTROPHOTOGRAPHIC COPIERS AND PRINTERS

BACKGROUND OF THE INVENTION

1. Field of the Invention

The invention relates to color copiers and printers and more particularly to automatic adjustment of parameters influencing the output copy color balance, color fidelity, and tone reproduction.

2. Description of the Prior Art

In electrophotographic copying a color original document, several factors inhibit perfect and constant color reproduction in terms of color balance, color fidelity, and tone reproduction. These factors include variation in the color and intensity of the light source used to illuminate the document, variation in the spectral reflectance of the different colorants of the document, non-ideal color separation filters, variation in the photoresponse of the photoconductor, variation in the toning contrast in the different color development stations, and unwanted absorptions in the colored toners.

Prior art systems attempt to diminish the adverse effects of these factors using manual or automatic set up systems, or a combination of both. In typical manual set up systems, a skilled operator examines the output reproduction (copy or print) and the corresponding input and output density ($D_{in}$-$D_{out}$) curves for red, green, blue, and black. Based on experience with the equipment, the operator determines adjustments to process control parameters, such as initial voltage $V_O$, exposure $E_O$, and development bias $V_b$. Several iterations of adjustment may be required to achieve acceptable color reproductions, in terms of color balance, color fidelity, and tone reproduction.

The set up procedure is complicated by the fact that a process control parameter adjustment which is favorable to one region of the reproduction may be detrimental for another. For example, a particular color may be too dark at high density levels and too light at low density levels. Accordingly, an adjustment to lighten the color to correct for high density errors would compound the low density error.

During set up, skilled operator will generally image a neutral density step tablet and adjust the process for hue neutrality of the reproduction. After achieving reasonable neutrality, the operator will adjust for good tone reproduction (i.e., good light-to-dark progression, contrast, and absence of abrupt density changes between density steps). Finally, the operator will check and adjust for neutrality again, all this in an iterative procedure until satisfied with the overall resultant reproduction quality. The set up inevitably involves compromises over all the color areas in the print, and even a highly skilled operator may be unable to achieve acceptable color reproduction within a reasonable time period.

Color copiers and printers are known which include automatic set up means for adjusting one or more of the process control parameters affecting the output color and density. Such automatic adjustment is typically based on density measurements of toned test patches for each color separation independently of the other color separations. However, the human observer is critical not only the appearance of individual colored areas taken individually, but also judges overall color and tone scale quality by the relationship of one color to another. For example, a slight hue error might be acceptable if the error is uniform over the entire image, but it would be unacceptable if the error is either (1) in one direction in some colors and in another direction in other colors or (2) in one direction for some densities and in another direction for other densities of the same color.

SUMMARY OF THE INVENTION

This invention is a procedure for automatic set up of process control parameters for good color balance, color fidelity, and tone reproduction by exploiting all of the available process parameter adjustments based on several density measurements in each of a plurality of color separations.

In accordance with the present invention, density measurements are made of a plurality of color separations across a range of densities for each color separation. Process control parameter adjustments are calculated utilizing the known average human relative visual sensitivities to density and color shifts at various density levels, to achieve an optimum set up compromise over all the colors.

In a preferred embodiment, if certain colors or densities are particularly important in the scene of the original document, those colors or densities are more heavily weighted in the adjustment calculations. These heavily weighted colors may be a mix of grays and non-grays. Light and dark flesh tones, for example, are important in many scenes. The adjustment procedure is preferably iterated a few times to attain convergence to the "best" set up.

According to a specific embodiment of the present invention, apparatus for automatically adjusting process control parameters includes means for producing a plurality of color separations and for making a plurality of color separation density measurements across a range of densities for each color separation. A set of error signals are calculated in accordance with average human visual sensitivities to density and color shifts at various density levels. The set of error signals are used to calculate a set of process control parameter adjustment signals to minimize a performance index which is a positive function of said error signals. The performance index may be selected from a group of performance indexes including average error, sum of cubed errors, sum of absolute errors, and sum of squared errors, etc.

In accordance with yet another embodiment of the present invention, the adjustment signal calculations are weighted for certain colors, density levels, and/or scene content determined to be of particular importance in the image.

In accordance with still another embodiment of the present invention, abruptness of adjustments to process control parameters and large cumulative magnitudes of iterated adjustments within the performance index are penalized.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENT

The present invention is described below in the environment of an electrophotographic copier. At the onset, it will be noted that although this invention is suitable for use with such machines, it also can be used with other types of electrostatographic copiers and printers.

For a detailed explanation of the theory of copier contrast and exposure control by controlling initial voltage $V_O$, exposure $E_O$, and development bias $V_b$, reference may be made to the following article: Paxton, Electrophotographic Systems Solid Area Response Model, 22 Photographic Science and Engineering 150 (May/June 1978).

Figure 1:
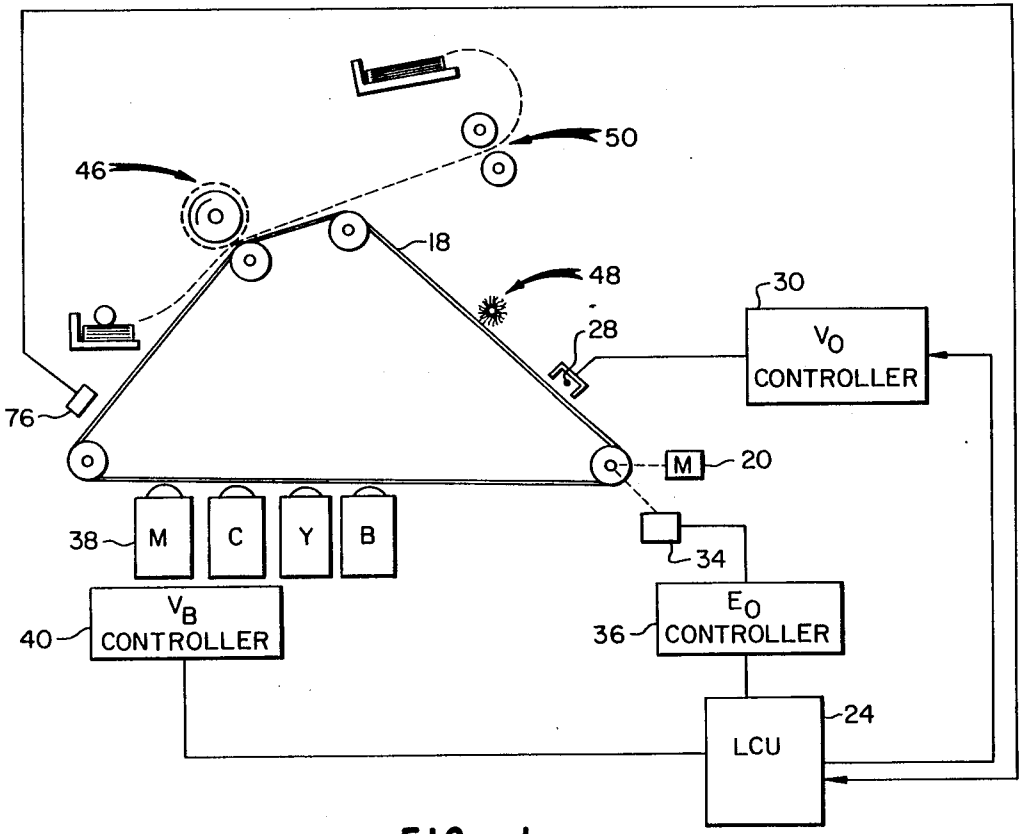
FIG. 1 is a schematic showing a side elevational view of an electrostatographic machine in which the present invention is useful.

Referring to FIG. 1, a moving transfer member such as photoconductive belt 18 is driven by a motor 20 past a series of work stations of the printer. A logic and control unit (LCU) 24, which has a digital computer, has a stored program for sequentially actuating the work stations.

For a complete description of the work stations, see commonly assigned U.S. Pat. No. 3,914,046. Briefly, a charging station 28 sensitizes belt 18 by applying a uniform electrostatic charge of predetermined primary voltage $V_O$ to the surface of the belt. The output of the charger is regulated by a programmable controller 30, which is in turn controlled by LCU 24 to adjust primary voltage $V_O$.

At an exposure station 34, projected light from a write head dissipates the electrostatic charge on the photoconductive belt to form a latent image of a document to be copied or printed. The write head preferably has an array of light-emitting diodes (LED's) or other light source for exposing the photoconductive belt picture element (pixel) by picture element with an intensity regulated by a programmable controller 36 as determined by LCU 24. Alternatively, exposure may be by means of optical projection of light reflected from an original document.

Travel of belt 8 brings the areas bearing the latent charge images into a development station 38. The development station has a magnetic brush for each color toner in juxtaposition to, but spaced from, the travel path of the belt. Magnetic brush development stations are well known. For example, see U.S. Pat. No. 4,473,029 to Fritz et al and 4,546,060 to Miskinis et al.

LCU 24 selectively activates the development station in relation to the passage of the image areas containing latent images to selectively bring the magnetic brush into engagement with the belt. The charged toner particles of the engaged magnetic brush are attracted to the oppositely charged latent imagewise pattern to develop the pattern.

As is well understood in the art, conductive portions of the development station, such as conductive applicator cylinders, act as electrodes. The electrodes are connected to a variable supply of D.C. potential $V_B$ regulated by a programmable controller 40.

A transfer station 46 and a cleaning station 48 are both fully described in commonly assigned U.S. patent application Ser. No. 809,546, filed December 16, 1985. After transfer of the unfixed toner images to a receiver sheet, such sheet is transported to a fuser station 50 where the image is fixed.

Logic and Control Unit (LCU)

Programming commercially available microprocessors is a conventional skill well understood in the art. The following disclosure is written to enable a programmer having ordinary skill in the art to produce an appropriate control program for such a microprocessor. The particular details of any such program would depend on the architecture of the designated microprocessor.

Figure 2:
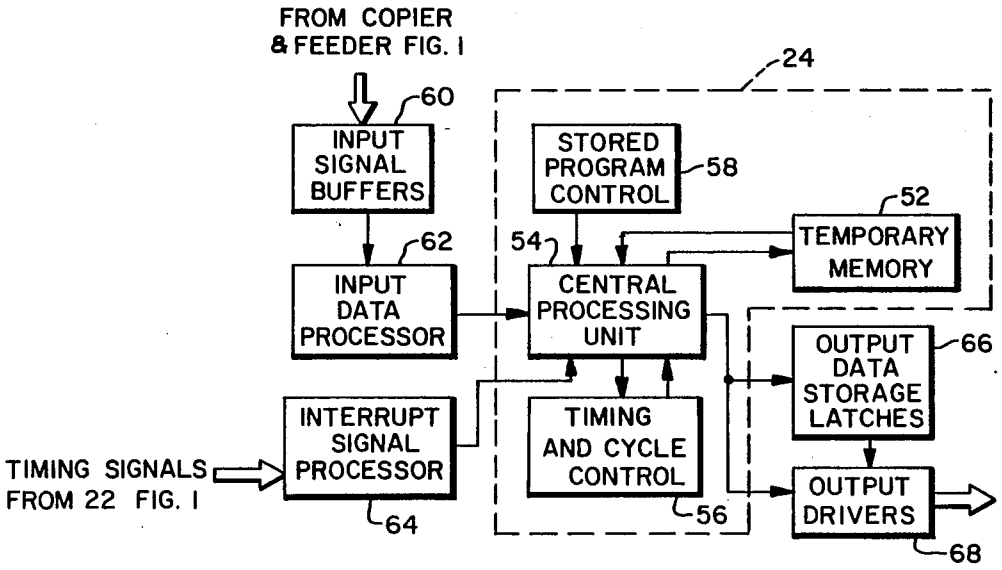
FIG. 2 is a block diagram of the logic and control unit shown in FIG. 1.

Referring to FIG. 2, a block diagram of a typical LCU 24 is shown. The LCU consists of temporary data storage memory 52, central processing unit 54, timing and cycle control unit 56, and stored program control 58. Data input and output is performed sequentially under program control. Input data are applied either through input signal buffers 60 to an input data processor 62 or through an interrupt signal processor 64. The input signals are derived from various switches, sensors, and analog-to-digital converters.

The output data and control signals are applied directly or through storage latches 66 to suitable output drivers 68. The output drivers are connected to apropriate subsystems.

Feedback Control

Process control strategies generally utilize various sensors to provide real-time control of the electrostatographic process and to provide "constant" image quality output from the user's perspective.

One such sensor may be a densitometer 76 (FIG. 1) to monitor development of test patches on the photoconductive belt 18, as is well known in the art. The densitometer may consist of an infrared LED which shines through the belt or is reflected by the belt onto a photodiode. The photodiode generates a voltage proportional to the amount of light received. This voltage is compared to the voltage generated due to transmittance or reflectance of a bare patch, to give a signal representative of an estimate of toned density.

Figure 3:
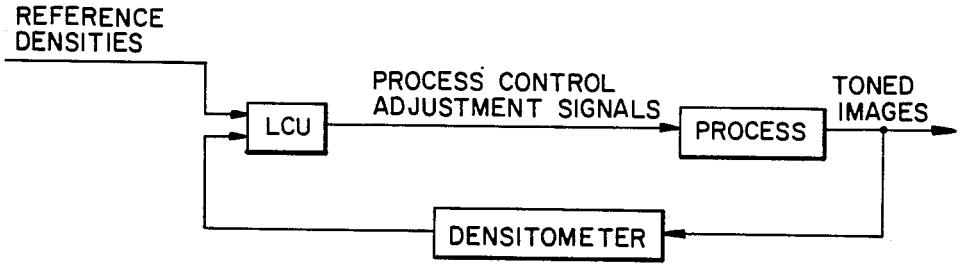
FIG. 3 is a block diagram of the system for effecting the color quality improvements in accordance with the present invention.

Referring to FIG. 3, LCU 24 receives signals from densitometer 76, and compares the signal from the densitometer to a reference signal indicative of ideal densities for each patch. In the case of reflection densities, the ideal may be taken as the reflection density of the original or a "compressed" version of the original, i.e., compressed to a smaller density range. In the case of transmission density patches, an operator adjusts the machine process control parameters manually to a best copy, and patch transmission densities are stored for future reference.

Figure 4:
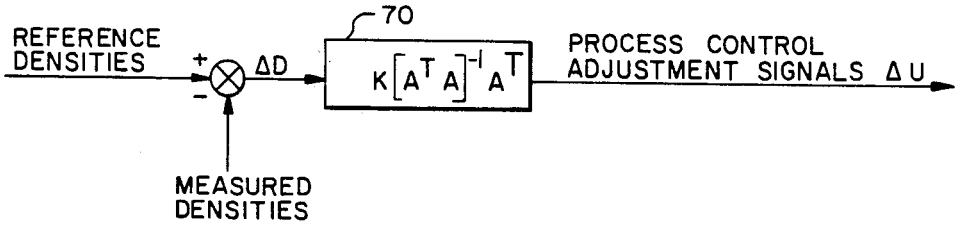
FIGS. 4 and 5 are functional block diagrams showing computations used in accordance with the present invention.

During automatic set up, LCU 24 determines the error between the actual measured densities and reference densities, and calculates process control parameter adjustment signals to minimize a preferred performance index. The performance index is a positive function of the errors, and might be chosen to minimize average absolute error, sum of absolute cubed errors, sum of absolute errors, sum-of-squared errors, etc. For example, a process control parameter adjustment signal calculation which drives the density errors toward a minimum sum-of-squares, i.e., a quadratic performance index is shown in FIG. 4. A controller 70 calculates a process control parameter adjustment vector "ΔU" by multiplying a vector "ΔD" of the output density errors by $K[A^TA]^{-1}A$, where "T" denotes the matrix transpose operation and the "A" matrix is the empirical linearized relationship in the copier or printer which describes how small changes in the manipulated process control parameters affect the density of the toned test patches. That is, the "A" matrix is the relationship between process control parameter adjustment vector "ΔU" and vector "ΔD" of the output density errors such that:

$$[\Delta D] = -[A][\Delta U] \tag{1}$$

The use of a quadratic performance index helps minimize the effect of neglecting the higher order (nonlinear) terms in the true relationship between ΔD and ΔU. For example, if there are five test patches and only two adjustable process control parameters available (i.e. $V_O$ and $E_O$), equation (1) has the following "A" matrix characterization for each color separation:

$$\begin{bmatrix} \Delta D_1 \\ \Delta D_2 \\ \Delta D_3 \\ \Delta D_4 \\ \Delta D_5 \end{bmatrix} = - \begin{bmatrix} a_{11} & a_{12} \\ a_{21} & a_{22} \\ a_{31} & a_{32} \\ a_{41} & a_{42} \\ a_{51} & a_{52} \end{bmatrix} \times \begin{bmatrix} \Delta V_0 \\ \Delta E_0 \end{bmatrix} \tag{2}$$

The sum-of-squares (quadratic) performance index to be minimized in FIG. 4 is given by:

$$\begin{aligned} J &= [\Delta D]^T [\Delta D]. \\ &= (\Delta D_1)^2 + (\Delta D_2)^2 + \ldots + (\Delta D_5)^2 \end{aligned} \tag{3}$$

Since equation (2) represents an undetermined system, it is generally not possible to drive all the steps to arbitrary desired density levels, i.e., to force performance index J equal to zero in equation (3). However, the pseudo-inverse operation of equation (4) below gives the adjustments which will, in principle, reduce the measured deviations to a minimum in a least squares sense, i.e., make "J" equal "$J_{min}$".

$$\begin{bmatrix} \Delta V_0 \\ \Delta E_0 \end{bmatrix} = [A^TA]^{-1}A^T \begin{bmatrix} \Delta D_1 \\ \Delta D_2 \\ \Delta D_3 \\ \Delta D_4 \\ \Delta D_5 \end{bmatrix} \tag{4}$$

The measurement and adjustment procedure indicated in FIG. 4 can be repeated, i.e., iterated, as many times as necessary to converge toward the desired result. Successive adjustments would be computed after the effects of the previous adjustments are detected in the measurements.

Scalar K in FIG. 4 is a value between zero and one, selected large enough for reasonably fast convergence of the iterations toward the minimum sum of squares, and small enough for good robustness with respect to modelling errors in the "A" matrix and disturbances. Modelling errors would include, for example, the error of representing the inherently nonlinear process by linear equation (1), as well as drift of the true "A" matrix over time. Disturbances would include stray light, line voltage fluctuations, photoconductor wear, and environmental effects which influence the output density.

Figure 5:
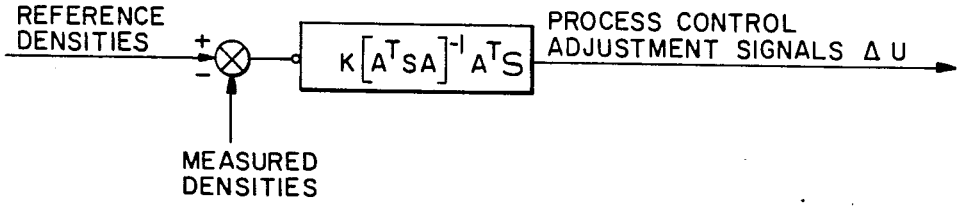

The above basic structure is enhanced in FIG. 5 to show least squares control of weighted vector ΔD, i.e., [B][ΔD], where the "B" matrix is the weighting matrix for the "ΔD" vector and where:

$$[S] = [B]^T[B],$$

The weighted "ΔD" vector may include relationships among patches as well as individual patches. For example, one element of the weighted "ΔD" vector might be the difference $\Delta D_1 - \Delta D_2$ between errors at different densities, recognizing that different errors at two density levels would be objectionable.

Figure 6:
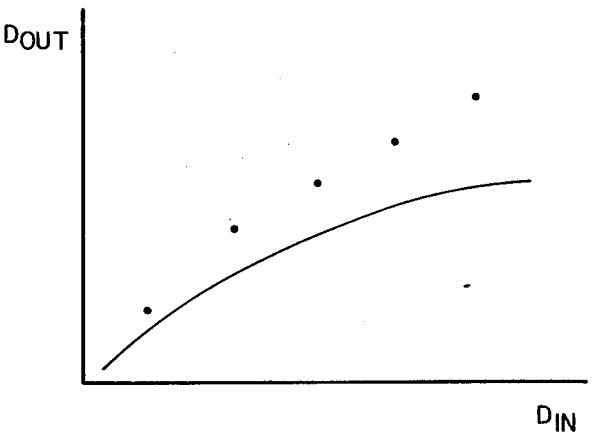
FIG. 6 is a graph of target and measured densities useful in understanding the present invention.

FIG. 6 shows a graph of a line of target densities and five measured densities. In the illustrated example, the measured densities have errors directly related to density. However, the eye is less sensitive to high density error than to low density error. Therefore, the error is multiplied by a weighting factor, where the heaviest weight factor is applied to the lowest density patch and the lightest weight factor is applied to the highest density patch. In fact, it may turn out after weighting that there is an equally severe apparent error at the low density end of the scale as at the high density end. For example, to weight five patches in the ratio of 14.3, 11.1, 8.33, 4.76, 2.7, the "B" matrix is defined as follows:

$$[B] = \begin{bmatrix} 14.3 & 0 & 0 & 0 & 0 \\ 0 & 11.1 & 0 & 0 & 0 \\ 0 & 0 & 8.33 & 0 & 0 \\ 0 & 0 & 0 & 4.76 & 0 \\ 0 & 0 & 0 & 0 & 2.7 \end{bmatrix}$$

and the "S" matrix would be:

$$[S] = \begin{bmatrix} 204 & 0 & 0 & 0 & 0 \\ 0 & 123 & 0 & 0 & 0 \\ 0 & 0 & 69.4 & 0 & 0 \\ 0 & 0 & 0 & 22.7 & 0 \\ 0 & 0 & 0 & 0 & 7.3 \end{bmatrix}$$

Non-zero off-diagonal elements of the "S" matrix would result when penalties are assigned to relationships among patch errors, rather than only to individual patch errors, as in the example above.

Figure 7:
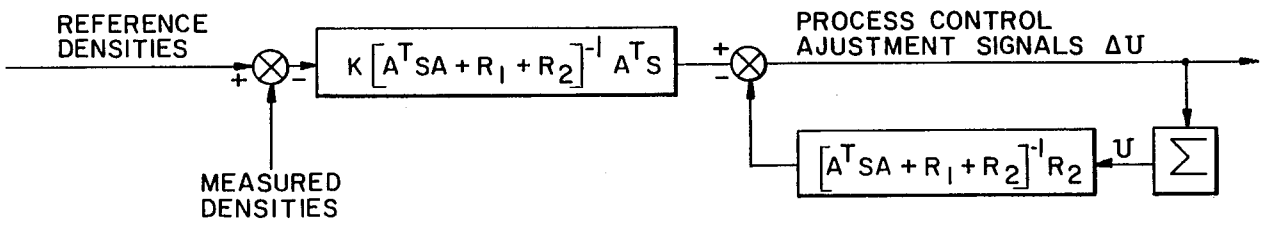
FIG. 7 is a functional block diagram showing computations used in accordance with the present invention.

The above basic structure is shown enhanced in FIG. 7 to show least squares control of weighted ΔD, modulated by $[R_1]$ penalties on abrupt adjustments, and by $[R_2]$ penalties on large cumulative adjustments. The performance index to be minimized in FIG. 7 is:

$$J = [\Delta D]^T S[\Delta D] + [\Delta U]^T R_1[\Delta U] + [U]^T R_2[U]$$

When abrupt adjustments are not objectionable, $R_1$ would be set to zero; and when there is no objection to extreme cumulative adjustments $R_2$ would be set to zero.

By the present invention, means are provided for fast automatic adjustment of apparatus to obtain a desirable color balance and tone reproduction. The procedure has the capability of exploiting all of the available process adjustment parameters. It utilizes process control patches, imaged on the color separations, which may exceed in number the number of adjustment parameters in each separation. These process control patches may include the colors most important in the scene content, as well as the conventional gray scale patches. Measurements of the patch image densities are fed back for use in calculating adjustments after being weighted according to their relative importance in the scene, and also according to their relative effect in the human visual response.

The invention has been described in detail with particular reference to preferred embodiments thereof, but it will be understood that variations and modifications can be effected within the spirit and scope of the invention.

What is claimed is:

1. In a color image reproduction device, apparatus for automatically adjusting process control parameters to achieve quality color reproductions in terms of color balance, color fidelity, and tone reproduction; said apparatus comprising:

means for producing a plurality of color separations;

means for making a plurality of color separation density measurements across a range of densities for each color separation;

computing means for calculating a set of error signals in accordance with average human visual sensitivities to density and color shifts at various density levels;

means responsive to said set of error signals for calculating a set of process control parameter adjustment signals to minimize a performance index which is a positive function of said error signals; and means responsive to said set of parameter adjustment signals for adjusting process control parameters to influence hue, saturation, and lightness of individual colors.

2. Apparatus as defined in claim 1 further comprising means for weighting the adjustment signal calculations for certain colors determined to be of particular importance in the image.

3. Apparatus as defined in claim 1 further comprising means for weighting the adjustment signal calculations for certain density levels determined to be of particular importance in the image.

4. Apparatus as defined in claim 1 further comprising means for weighting the adjustment signal calculations for certain colors and density levels determined to be of particular importance in the image.

5. Apparatus as defined in claim 1 further comprising means for penalizing abruptness of adjustments to process control parameters.

6. Apparatus as defined in claim 1 further comprising means for interating the adjustment procedure a plurality of times to attain convergence to a best reproduction.

7. Apparatus as defined in claim 6 further comprising means for penalizing large cumulative magnitudes of iterated adjustments to process control parameters.

8. Apparatus as defined in claim 6 further comprising means for penalizing:

abruptness of adjustments to process control parameters; and large cumulative magnitudes of iterated adjustments to process control parameters.

9. Apparatus as defined in claim 1 wherein the performance index is selected from a group of performance indexes consisting of average absolute error, sum of absolute cubed errors, sum of absolute errors, and sum of squared errors.

10. Apparatus as defined in claim 1 wherein the performance index is the sum of squared errors.

11. Apparatus as defined in claim 1 wherein the performance index is weighted for human visual sensitivity.

12. Apparatus as defined in claim 1 wherein the performance index is weighted for scene content.

13. Apparatus as defined in claim 1 wherein the performance index is weighted for human visual sensitivity and for scene content.

14. Apparatus as defined in claim 1 wherein the performance index is modulated by $[R_1]$ penalties on abrupt adjustments, and by $[R_2]$ penalties on large cumulative adjustments, whereby the performance index to be minimized is:

$$J=[\Delta D]^T S[\Delta D]+[\Delta U]^T R_1[\Delta U]+[U]^T R_2[U].$$

* * * * *